US005720388A

United States Patent [19]

King et al.

[11] Patent Number: 5,720,388

[45] Date of Patent: Feb. 24, 1998

[54] POLYGONALLY SHAPED GOLF CLUB SHAFT PROTECTOR

[75] Inventors: Jon E. King, St. Louis; Phillip M. Brewer, Fenton, both of Mo.

[73] Assignee: Sinclair & Rush, Inc., St. Louis, Mo.

[21] Appl. No.: 589,549

[22] Filed: Jan. 22, 1996

[51] Int. Cl.[6] ..... A63B 57/00

[52] U.S. Cl. ..... 206/315.2; 206/315.6; 150/160

[58] Field of Search ..... 206/315.2, 315.3, 206/315.6; 211/70.2; 150/160

[56] References Cited

U.S. PATENT DOCUMENTS

| | | | |
|---|---|---|---|
| 2,023,792 | 12/1935 | Sampson | 206/315.4 |
| 2,799,315 | 7/1957 | Strasburg | 206/315.2 |
| 2,860,679 | 11/1958 | Kouke | 211/70.2 |
| 3,985,229 | 10/1976 | Maki | 206/315.6 |
| 4,142,563 | 3/1979 | Ackerfeldt et al. | 206/315.6 X |
| 4,172,484 | 10/1979 | Henning | 206/315.6 |
| 4,173,241 | 11/1979 | Stock | 150/1.5 R |
| 4,664,382 | 5/1987 | Palmer et al. | 206/315.6 X |
| 4,932,523 | 6/1990 | Yamazoe | 206/315.6 |
| 5,088,600 | 2/1992 | Kopp, Jr. | 206/315.2 |
| 5,094,345 | 3/1992 | Yonnetti | 206/315.2 |
| 5,255,781 | 10/1993 | Dulyea, Sr. | 206/315.6 |
| 5,275,278 | 1/1994 | Henry et al. | 206/315.6 |
| 5,392,907 | 2/1995 | Blanchard et al. | 206/315.6 |
| 5,575,720 | 11/1996 | Daniel | 206/315.2 X |

*Primary Examiner*—Sue A. Weaver

*Attorney, Agent, or Firm*—Polster, Lieder, Woodruff & Lucchesi, LLC

[57] ABSTRACT

A golf club shaft protector is disclosed as including an elongated hollow plastic tube having a polygonal cross-sectional configuration with an unequal number of sides interconnected to each other by corner sections. Each of the unequal number of sides have the same predetermined length and each of the corner sections have the same predetermined angular shape. One of each of the corner sections faces one of each of the sides. Preferably, the unequal number of sides is at least seven to provide the largest possible opening with the greatest amount of rigidity for receiving the golf club shaft, including a golf club handle. The golf club shaft protector also includes a tubular element mounted adjacent the open upper end of the hollow plastic tube and includes an outer wall section, an inner wall section and flexible lip sections. The outer wall section surrounds an outer wall area of the tube adjacent the open upper end, the inner wall section surrounds an inner wall area of the tube adjacent the open upper end and the flexible lip sections extend over the open upper end of the tube for resiliently supporting a golf club shaft in centered position relative to the hollow plastic tube. The aforementioned elements facilitate the entry and removal of a golf club shaft including a golf club handle or grip, while protecting the golf club shaft against marring, scratching or other damage while retained within the hollow plastic tube.

6 Claims, 2 Drawing Sheets

POLYGONALLY SHAPED GOLF CLUB SHAFT PROTECTOR

BACKGROUND OF THE INVENTION

The present invention relates to a golf club shaft protector, and more particularly, to a polygonally shaped golf club shaft protector having an unequal number of sides, preferably seven in number, and to a tubular element mounted on an open upper end of the golf club shaft protector which resiliently supports a golf club shaft in centered position within the golf club shaft protector while protecting the golf club shaft against marring, scratching or other damage.

Protection of golf clubs, including golf club heads and golf club shafts, has always been important. Golf club heads are conventionally protected by a variety of different golf club covers, some of the most successful of which are shown in U.S. Pat. Nos. 5,117,884 and 5,415,213.

The protection of golf club shafts has become increasing important with the development of graphite, titanium, and other exotic golf club shafts since they are very expensive, and yet can be easily marred or scratched. Some prior art golf club shaft protector developments, such as those shown in U.S. Pat. Nos. 3,985,229; 4,173,241; 4,664,382; 4,932,523; and 5,255,781, have not been successful due to the failure to consider practical and economic aspects in designing such a golf club shaft protector.

As a result, the golf club shaft protector shown in U.S. Pat. No. 5,275,278 was developed to provide protection for essentially the entire golf club shaft below the golf club head while fulfilling the practical and economic needs for such a product. While the golf club shaft protector shown in U.S. Pat. No. 5,275,278 has overcome many of the problems associated with prior art devices, some problems still remain. These include collapse of the tubes when a golf bag is laid on its side inside the trunk of a car. The weight of adjacent golf clubs collapses the golf club shaft protector tubes and creates the potential for damage or marring to golf club shafts. In addition, the upper marginal area at the upper end of the hollow plastic tubes provides an edge surface that, when the golf club shaft protector tubes are collapsed, brings such edge surface into contact with the golf club shaft, also resulting in damage to the golf club shaft.

As will be discussed in detail below, the polygonally shaped golf club shaft protector, by itself, and together with the tubular element mounted on an upper end of the golf club shaft protector, overcomes the problems associated with the prior art, while retaining the practical, reliable and economical aspects required for such a golf club shaft protector.

SUMMARY OF THE INVENTION

Among the several objects and advantages of the present invention include:

The provision of a new and improved polygonally shaped golf club shaft protector which protects essentially the entire golf club shaft below the golf club head during use, travel, and storage of golf clubs;

The provision of the aforementioned polygonally shaped golf club shaft protector which prevents collapse of such golf club shaft protectors, particularly when stored in the trunk of a user's automobile;

The provision of the aforementioned polygonally shaped golf club shaft protector which has an unequal number of sides, preferably seven in number, to provide the maximum possible opening for a golf club shaft, including the golf club handle or grip, while affording substantial lateral rigidity against collapse;

The provision of a golf club shaft protector which provides a tubular element mounted adjacent the open upper end of the golf club shaft protector tube which surrounds the outer wall area of the tube adjacent the open upper end, an inner wall area which surrounds an inner wall area adjacent the open upper end of the tube and flexible lip sections to facilitate resilient deformation and engagement with the golf club shaft, including the golf club handle or grip;

The provision of the aforementioned golf club shaft protector in which the aforementioned tubular element includes a flexible restricted throat element for resilient deformation and return following insertion of a golf club shaft and handle therethrough;

The provision of the aforementioned golf club shaft protector which is simply and easily constructed by known manufacturing techniques; is easy to use and maintain; is practical for use, travel and storage of golf clubs; is extremely economical; and is otherwise well adapted for the purposes intended.

Briefly stated, the golf club shaft protector of the present invention includes an elongated hollow plastic tube having a polygonal cross-sectional configuration with an unequal number of sides, the adjacent sides of the tube being interconnected to each other by corner sections.

Each of the unequal number of sides have the same predetermined length and each of the corner sections have the same predetermined angular shape. One of each of the corner sections faces one of each of the sides.

Preferably, the unequal number of sides is at least five, and most preferably at least seven in number, in order to provide the maximum possible opening in a substantially rigid element of minimum predetermined configuration.

At the open upper end of the tube, a tubular element is provided having an outer wall section, an inner wall section, and flexible lip sections. The outer wall section surrounds an outer wall area of the tube adjacent the open upper end while the inner wall section surrounds an inner wall area of the tube adjacent the open upper end. The flexible lip sections extend over the open upper end of the tube for resilient deformation upon the passage of a golf club handle and for resilient return in order to resiliently engage the golf club shaft in centered position in the tube and below a golf club head.

The outer wall section conforms to the shape of the tube while the inner wall section is circumferentially spaced from the tube at least along certain portions thereof.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way limitation. This description will clearly enable one skilled in the art to make and use the invention, and describes several embodiments, adaptions, variations, alternatives and uses of the invention, including what I presently believe is the best mode of carrying out the invention.

Figures 1, 2, 3:
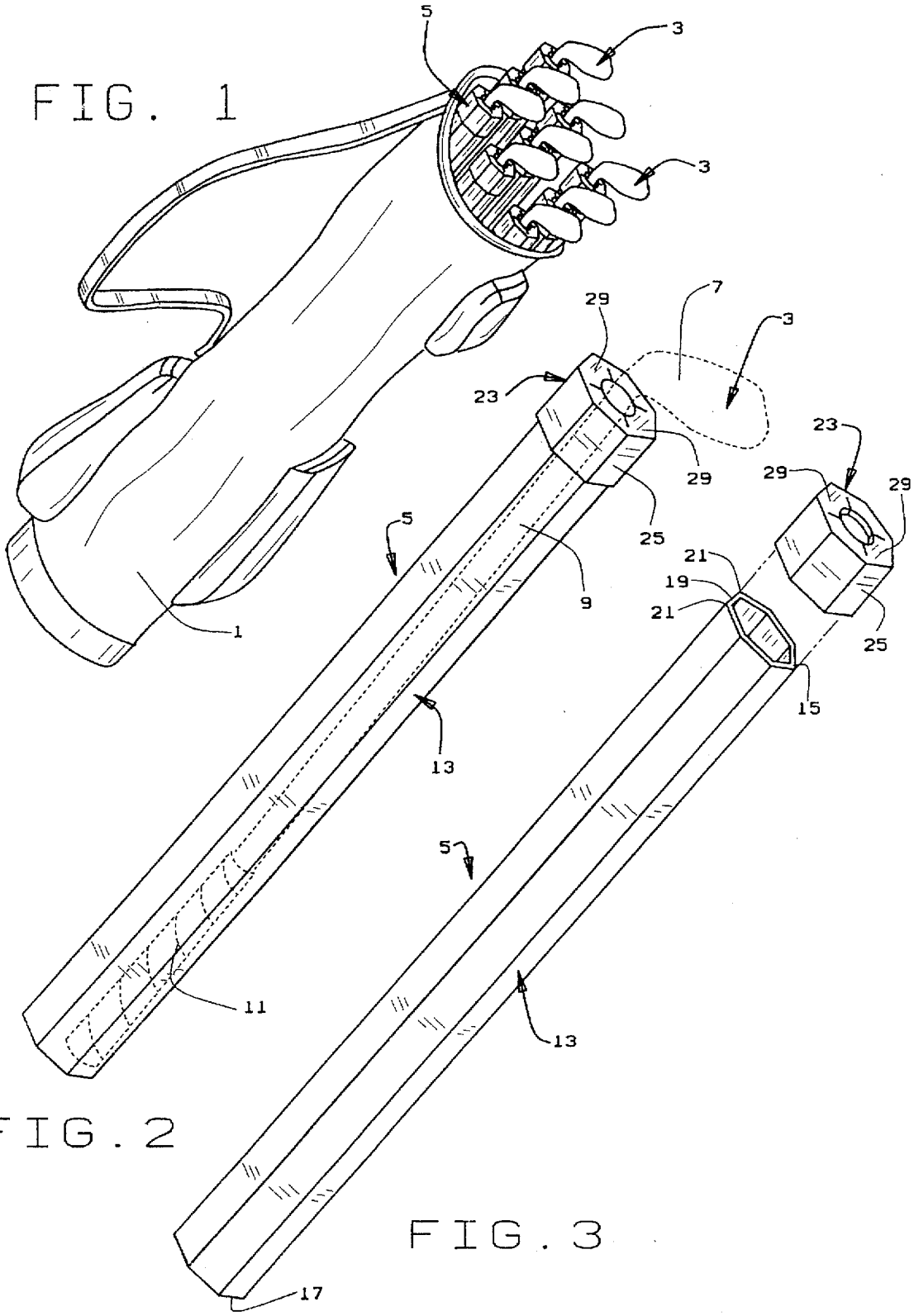
FIG. 1 is a perspective view illustrating a typical golf club bag with golf clubs positioned in polygonally shaped golf club protectors constructed in accordance with the present invention.
FIG. 2 is a perspective view of the polygonally shaped golf club protector of the present invention with a golf club shown in phantom lines positioned therein.
FIG. 3 is an exploded perspective view of the components which comprise the golf club shaft protector of the present invention.

FIG. 1 of the drawings illustrates a typical golf bag 1 containing a plurality of golf clubs 3 which are inserted in a corresponding number of golf club shaft protectors 5, constructed in accordance with the teachings of the present invention. Each of the golf club shaft protectors 5 support a single golf club 3 in the golf bag 1.

As illustrated in FIG. 2 of the drawings, the typical golf club 3 includes a golf club head 7, an elongated flexible shaft 9 and a handle or grip 11 at the end of the golf club shaft 9 opposite the golf club head 7. The golf club shaft protector 5 of the present invention is constructed to provide protection against marring, scratching or other damage to the golf club shaft 9, between the golf club head 3 and the golf club handle or grip 11. In some golf club constructions, there is a tapered wrap or wound section about three inches long located beneath the golf club head 7 and known as a hosel (not shown). The golf club shaft protector 5 is designed to provide protection for the entire golf club shaft 9, from the golf club head 7 to the golf club handle or grip 11, including a hosel (not shown) immediately below the golf club head 7 in certain golf club constructions.

Figure 4:
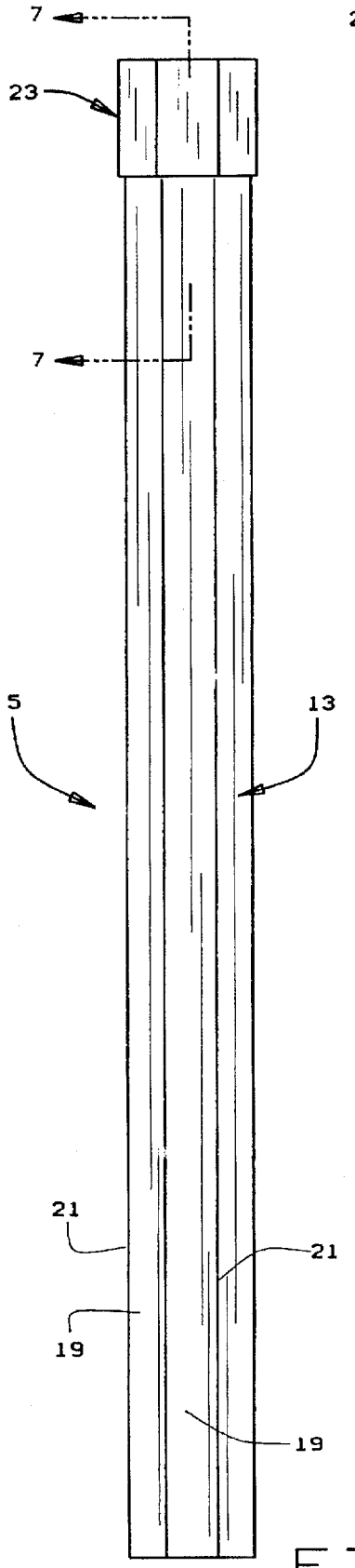
FIG. 4 is an enlarged side elevational view of the polygonally shaped golf club shaft protector of the present invention.

FIGS. 2–4 of the drawings best illustrate the golf club shaft protector as comprising a hollow plastic tube 13 of polygonal cross-sectional configuration. The hollow polygonally shaped tube 13 can be formed from suitable plastic materials, polypropylene being one preferred example. The polygonally shaped hollow plastic tube 13 has a length generally corresponding to the length of the golf club shaft 9 with open upper and lower ends 15, 17, as illustrated in FIG. 3.

The polygonally shaped hollow plastic tube 13 is constructed with an unequal number of sides 19 which are interconnected to each other by corner sections 21. Each of the unequal sides 19 have the same predetermined length and each of the corner sections 21 have the same predetermined angular shape. Such a construction enables one of each of the corner sections 21 to face one of each of the sides 19. A polygonal shape with sides of equal length is also known as a regular polygonal shape.

As illustrated, the polygonally shaped hollow plastic tube 13 preferably has seven sides 19 of the same predetermined length and seven corner sections 21 of the same predetermined angular shape. A seven side polygonal shape is also known as a septagon. By having one of each of the corner sections 21 facing one of each of the sides 19 in the seven sided polygonal cross-sectional configuration of the polygonally shaped hollow plastic tube 13, a substantially rigid tube construction will be provided, while affording the maximum possible opening to receive the golf club handle or grip 11. When positioned within the polygonally shaped hollow plastic tube 13, the golf club shaft 9 is thus afforded substantial rigidity since the seven sided polygonally shaped hollow plastic tube 13, with one of each of the corner sections 21 facing one of each of the sides 19, in order to provide resistance against collapse of the polygonally shaped hollow plastic tube 13.

While the preferred number of unequal sides of the polygonally shaped plastic tube is seven in number for the reasons set forth above, it is conceivable that a regular polygonal shape of three or five sides may also be feasible for certain applications, as long as each of the unequal sides have the same predetermined length, each of the corner sections have the same predetermined angular shape, and one of each of the corner sections 21 faces one of each of the sides 19. However, with a polygonal cross-sectional shape of three or five sides, the internal shape of such a tube construction will not provide the maximum possible opening with a minimum external peripheral shape, as would be the case with a regular seven-sided or even larger number of sides for the hollow plastic tube.

Figure 5:
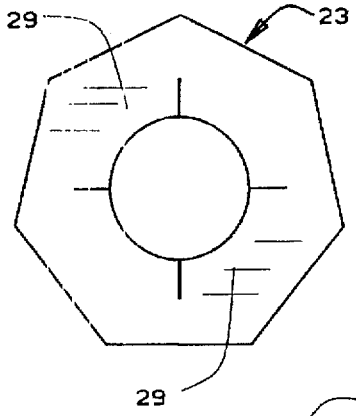
FIG. 5 is a top plan view of the open upper end of the polygonally shaped golf club shaft protector of the present invention.

In order to facilitate the mounting of a golf club 3 in the polygonally shaped hollow plastic tube 13 while enabling the golf club shaft 9 to be generally centered within the polygonally shaped hollow plastic tube 13, a tubular element 23 is provided. As illustrated in FIG. 3, the tubular element 23 is formed separate from the polygonally shaped hollow plastic tube 13 and is subsequently mounted over the open upper end 13 of the polygonally shaped hollow plastic tube 13, as best seen in FIGS. 2, 4 and 5 of the drawings. The flexible tubular member 23 is preferably formed from a flexible and resilient material such as polyvinylchloride, enabling it to be telescopically mounted over the open upper end 15 of the polygonally shaped hollow plastic tube 13.

Figure 7:
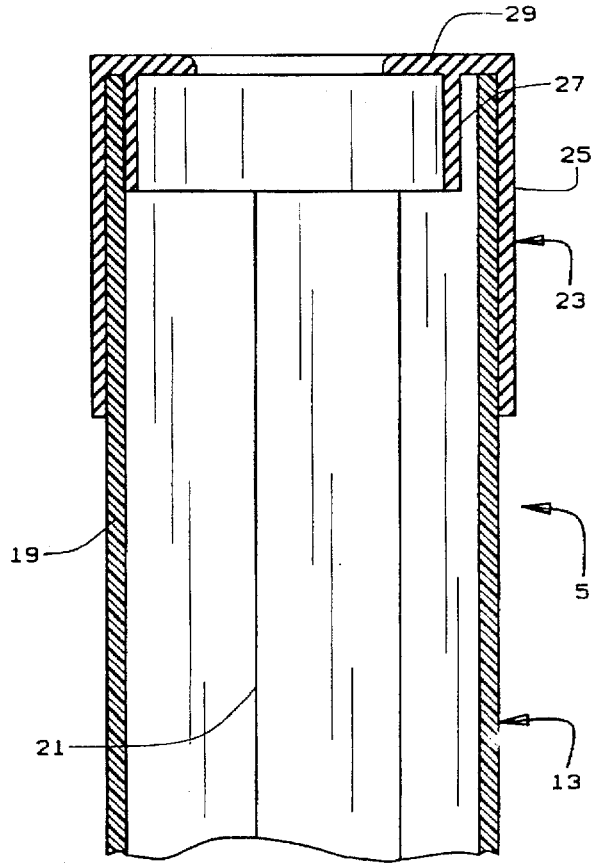
FIG. 7 is an enlarged fragmentary cross sectional view illustrating the construction of the tubular element mounted relative to the open upper end of the polygonally shaped golf club shaft protector of the present invention.

As best seen in FIGS. 2–5 and 7 of the drawings, the tubular element 23 includes an outer wall section 25, an inner wall section 27, and flexible lip sections 29 integrally formed and interconnected to one another, as illustrated. Specifically, both of the inner and outer wall sections 25, 27 of the tubular element 23 are integrally interconnected at their upper ends to the flexible lip sections 29, as best seen in FIG. 7 of the drawings.

Figure 6:
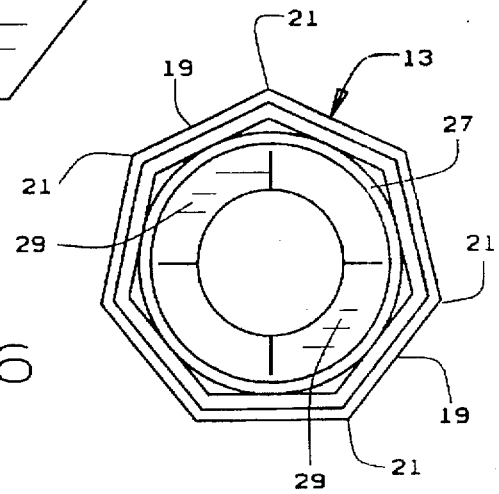
FIG. 6 is a bottom plan view of the polygonally shaped golf club shaft protector of the present invention.

The outer wall section 25 of the tubular element 23 preferably has a seven sided or septagonal shape corresponding to the seven sided or septagonal shape of the hollow plastic tube 13. The outer wall section 25 thus readily conforms to an outer wall area of the polygonally shaped hollow plastic tube 13 adjacent the open upper end 15, as best seen in FIG. 7 of the drawings. The inner wall section 27 is substantially shorter in length than the outer wall section 25 and also has a generally cylindrical, rather than a polygonal shape. As a result, the generally cylindrically shaped inner wall section 27 is shown in FIG. 6 of the drawings as spanning the corner sections 21 of the polygonally shaped hollow plastic tube 13. This provides an added cushioning element for the golf club shaft 9 which works in conjunction with the flexible lip sections 29. Specifically, as best illustrated in FIG. 7 of the drawings, the fight hand side of the tubular element 23 is shown as illustrating the inner wall section 27 as being integrally connected to the flexible lip sections 29, while being laterally spaced from the polygonally shaped hollow plastic tube 13 in one of the corner sections 21 of the polygonally shaped hollow plastic tube 13. As a result, the flexible lip sections 29, together with those areas of the inner wall section 27 that are spaced from the corner sections 21 of the polygonally shaped hollow plastic tube 13, provide a shock absorbing and cushioning element for a golf club shaft 9, due to any collapsing or other force exerted on the polygonally shaped hollow plastic tube 13.

The flexible lip sections 29 cooperate to define a flexible restrictive throat element which extends across the open upper end 15 of the polygonally shaped hollow plastic tube for resilient deformation upon the insertion of the golf club handle or grip 11 and associated golf club shaft 9 therethrough and for subsequent resilient return to its initial shape in order to provide close fitting circumferential and resilient support of a golf club shaft 9 adjacent the golf club head 7. Once the golf club shaft 9 is received within the polygonally shaped hollow plastic tube 13, the flexible lip sections 29, together with those areas of the circumferential inner wall section 27 that are spaced from the corner sections 21 of the polygonally shaped hollow plastic tube 13, serve to provide the resilient and cushioned support for the golf club shaft 9 throughout its length except in the golf club handle or grip 11. The golf club handle or grip 11 may also be in at least substantial peripheral engagement or partial peripheral engagement with an inner wall area of the polygonally shaped hollow plastic tube 13 at its lower outer end 17, as illustrated in FIG. 2 and as more specifically described in U.S. Pat. No. 5,275,278. Alternatively, the golf club handle or grip 11 may be moved small distances within the confines of the polygonally shaped hollow plastic tube 13; however, in any case, the golf club shaft 9, above the golf club handle or grip 11, will be spaced from the inner wall area of the polygonally shaped hollow plastic tube 13, due to the aforementioned flexible lip sections 29 and the manner in which they cooperate with spaced areas of the inner circumferential section 27 of the tubular element 23.

From the foregoing, it will be appreciated that the golf club shaft protector 5 of the present invention provides substantial rigidity against collapse due to its polygonal cross sectional configuration. Further, due to the unequal number of sides in the polygonal cross sectional configuration, preferably seven in number to form a regular septagonal hollow plastic tube 13, one of each of the corner sections faces one of each of the sides, thus affording substantial lateral rigidity in a relatively small dimensional configuration, while affording the maximum possible opening for a golf club shaft, including golf club handle or grip. When used in conjunction with a tubular member that provides substantial resilient and shock absorbing circumferential support adjacent the open upper end of the hollow plastic tube, the golf club shaft, between the golf club head and the golf club handle or grip, will be substantially centered relative to the polygonally shaped hollow plastic tube, while being circumferentially supported in resilient and shock absorbing engagement adjacent the open upper end of the polygonally shaped hollow plastic tube. As a result, there is little opportunity for the golf club shaft to be scratched, marred or otherwise damaged while it is retained within the golf club shaft protector of the present invention.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A golf club shaft protector comprising:

an individual self-supporting elongated hollow plastic tube having a polygonal cross-sectional configuration with seven sides, adjacent sides of the tube being interconnected to each other by corner sections;

each of seven sides have the same predetermined length and each of the corner sections have generally the same predetermined angular shape; and each of the corner sections faces one of each of the sides.

2. The golf club shaft protector as defined in claim 1 in which the hollow plastic tube has opposite open ends and includes a flexible restricted throat element which extends across one open end of the tube for resilient deformation upon the insertion of a golf club handle to allow passage of a golf club handle and associated shaft there through and for subsequent resilient return to its initial shape in order to provide close fitting circumferential support of a golf club shaft adjacent a golf club head of the golf club.

3. A golf club shaft protector comprising:

an elongated hollow plastic tube with opposite open ends and having a polygonal cross-sectional configuration of seven sides;

adjacent sides of the tube having the same predetermined length and being interconnected to each other by corner sections;

each of the corner sections having the same predetermined angular shape; and one of each of the corner sections facing one of each of the sides.

4. The golf club shaft protector as defined in claim 3 including a tubular element of predetermined length having outer and inner wall sections which overlie outer and inner wall areas of the tube adjacent one open end, said tubular element also including flexible lip sections for resiliently supporting a golf club shaft in a generally centered position relative to the tube.

5. The golf club shaft protector as defined in claim 4 wherein the outer wall section conforms to the sides and corner sections of the tube while the inner wall section has a generally cylindrical shape which spans the corner sections of the tube.

6. A golf club shaft protector comprising:

an elongated hollow plastic tube of polygonal cross sectional configuration having seven sides;

adjacent sides of the tube having the same predetermined length and being interconnected to each other by corner sections;

each of the corner sections having the same predetermined angular shape;

one of each of the corner sections facing one of each of the sides; and a throat element extending across an upper open end of the tube for general centering of a golf club shaft within the tube.

* * * * *